US006764586B1

(12) United States Patent
Fleury

(10) Patent No.: US 6,764,586 B1
(45) Date of Patent: Jul. 20, 2004

(54) METHOD FOR ELECTROCHEMICALLY METALLIZING AN INSULATING SUBSTRATE

(75) Inventor: Vincent Fleury, Paris (FR)

(73) Assignee: Centre National de la Recherche Scientifique, Paris (FR)

( * ) Notice: Subject to any disclaimer, the term of this patent is extended or adjusted under 35 U.S.C. 154(b) by 10 days.

(21) Appl. No.: 10/110,126

(22) PCT Filed: Oct. 4, 2000

(86) PCT No.: PCT/FR00/02757

§ 371 (c)(1),
(2), (4) Date: Apr. 9, 2002

(87) PCT Pub. No.: WO01/27356

PCT Pub. Date: Apr. 19, 2001

(30) Foreign Application Priority Data

Oct. 11, 1999 (FR) ..... 99 12644

(51) Int. Cl.[7] ..... C25D 5/54; C25D 5/56

(52) U.S. Cl. ..... 205/159; 205/160; 205/162; 205/164

(58) Field of Search ..... 205/159, 160, 205/162, 163, 164, 166

(56) References Cited

U.S. PATENT DOCUMENTS 2,596,515 A * 5/1952 Watkins et al. ..... 205/50

6,572,743 B2 * 6/2003 Miller et al. ..... 204/297.06

FOREIGN PATENT DOCUMENTS

FR 2 746 116 9/1997

OTHER PUBLICATIONS

International Search Report issued in connection with PCT/FR00/02757, no date.

* cited by examiner

*Primary Examiner*—Edna Wong
(74) *Attorney, Agent, or Firm*—Burns, Doane, Swecker & Mathis, L.L.P.

(57) ABSTRACT

Provided is a process for metallizing an insulating substrate by depositing a uniform thin film of a metal on the insulating substrate. The process comprises placing the insulating substrate in an electrochemical cell which contains as the electrolyte a solution of a salt of the metal in a solvent, and which comprises an anode of the metal and a cathode in direct contact with the insulating substrate. A conducting film, which will constitute the cathode, is initially applied to one end of the substrate. The substrate is placed in the electrochemical cell in such a way that the surface to be metallized is vertical and the cathode is located in the upper part. A current is imposed on the electrochemical cell with an intensity such that it creates a current density of between 1 and 50 mA/cm$^2$ in the horizontal section of the electrochemical cell level with the growth front of the film which is deposited.

10 Claims, 2 Drawing Sheets

METHOD FOR ELECTROCHEMICALLY METALLIZING AN INSULATING SUBSTRATE

BACKGROUND OF THE INVENTION

1. Field of the Invention

The present invention relates to a process for electrochemically metallizing an insulating substrate.

2. Description of the Related Art

Various processes for metallizing insulating substrates, especially for the purpose of manufacturing mirrors by metallizing glass plates, are known.

The oldest processes consist in bringing the insulating plate to be metallized into contact with a solution of a metal salt and of a reducing solution which causes precipitation. The contacting may take place by spraying or by immersion. These processes require the use of a mixture of salts and optionally of additives. Furthermore, they do not make it possible to control either the rate of deposition or the texture, that is to say the quality of the coating obtained.

More recently, processes based on vacuum evaporation deposition have been developed. This technique, very simple in its principle, requires a vacuum to be created before-hand in a chamber in which the evaporation of the metal will take place. The films obtained by vacuum evaporation are in general of good quality, but the high cost of the process limits their use to particular applications such as the production of small mirrors, for example rear-view mirrors used in motor vehicles or mirrors used in optics.

It is known to produce metal coatings on metal substrates electrolytically. Many applications have been developed with very good results. However, it is also known, especially from J. Dini, [*Electrodeposition*, Noyes Publication, Park Ridge N.J., USA (1992), page 195], that the use of the process with high growth rates causes an irregular dendritic or pulverulent growth. Such coatings are unuseable for industrial applications, as they break down into powder. One solution for limiting or eliminating the formation of dendrites during electrolytic deposition of a metal film on a conducting substrate consists in adding additives to the electrolyte. However, this process is essentially empirical. Good results may be obtained, but they are not easily reproducible. Furthermore, a slight change in the additive content or in its nature may cause considerable changes to the film deposited.

Independently, trials have been conducted in order to transpose the process of electrolytic deposition onto a metal substrate to the metallization of insulating substrates, for example the metallization of glass plates. For example, V. Fleury ["*Branched fractal patterns in non-equilibrium electrochemical deposition from oscillatory nucleation and growth*", Nature, Vol. 390 November 1997, 145–148] describes a process for the galvanic deposition of a copper film on an insulating substrate. That surface of the insulating substrate which is to be metallized is covered with a thin gold film. The substrate is then placed in a solution of a copper salt and is connected to an anode consisting of copper and a cathode consisting of a gold film, the two electrodes being connected to a current generator. The coating on the surface of the insulating substrate is obtained by the reduction of copper at the cathode. The reduced metal starts by being deposited at the cathode, and then the deposition continues on that surface to be metallized which is covered with the thin non-conducting film of gold. However, this case also results in a dendritic growth which does not form a completely covering uniform thin film. On the contrary, the structure of the coating is extremely arborescent and tortuous. It is known that, in such arborescent growth, the choice of current density imposed on the electrochemical cell allows the rate of formation of the metal coating to be modified, an increase in the current density producing an increase in the deposition rate. However, it has been found that an increase in the current density causes the formation of pulverulent dendritic coatings. Thus, T. R. Bergstrasser and H. D. Merchant ["Surface Morphology of Electrodeposits", pp. 115–168 in *Defect Structure, Morphology and Properties of Deposits*, Proceedings of the Materials Week Rosemont 1994, Publication of the Minerals-Metals-Materials Society, ed. by H. D. Merchant] show that the higher the current intensity used with respect to the equilibrium current intensity, the more the coatings formed are pulverulent in nature. The three-dimensional powders thus obtained are of no industrial use, their sole advantage being to allow the fundamental study of fractal dendritic growth (J. Dini, *ibid.* page 175).

SUMMARY OF THE INVENTION

The research carried out by the inventor has allowed him to show that, when an electrochemical process is used to grow powders along the surface of a substrate, by applying a markedly higher current density to the electrochemical cell than the current densities above which, according to the prior art, only three-dimensional powders could be obtained, a coating on the substrate was obtained in which the grains are arranged so as to form a uniform covering film and no longer dendrites.

This is why the subject of the present invention is an electrochemical process for the deposition of a continuous thin metal film on an insulating substrate.

The process for metallizing an insulating substrate by depositing a uniform thin film of a metal M on the said insulating substrate consists in placing the said substrate in an electrochemical cell which contains as electrolyte a solution of a salt of the metal M in a solvent and which comprises an anode consisting of the metal M and a cathode in direct contact with the said insulating substrate, then in carrying out an electrolysis at constant current, the said process being characterized in that:

- a conducting film, which will constitute the cathode, is initially applied to one end of the substrate;
- the substrate is placed in the electrochemical cell in such a way that the surface to be metallized is vertical and the cathode is located in the upper part; and
- a current is imposed on the electrochemical cell with an intensity such that it creates a current density of between 1 and 50 $mA/cm^2$ in the horizontal section of the electrochemical cell level with the growth front of the film which is deposited.

DETAILED DESCRIPTION OF THE PREFERRED EMBODIMENTS

Figure 1:
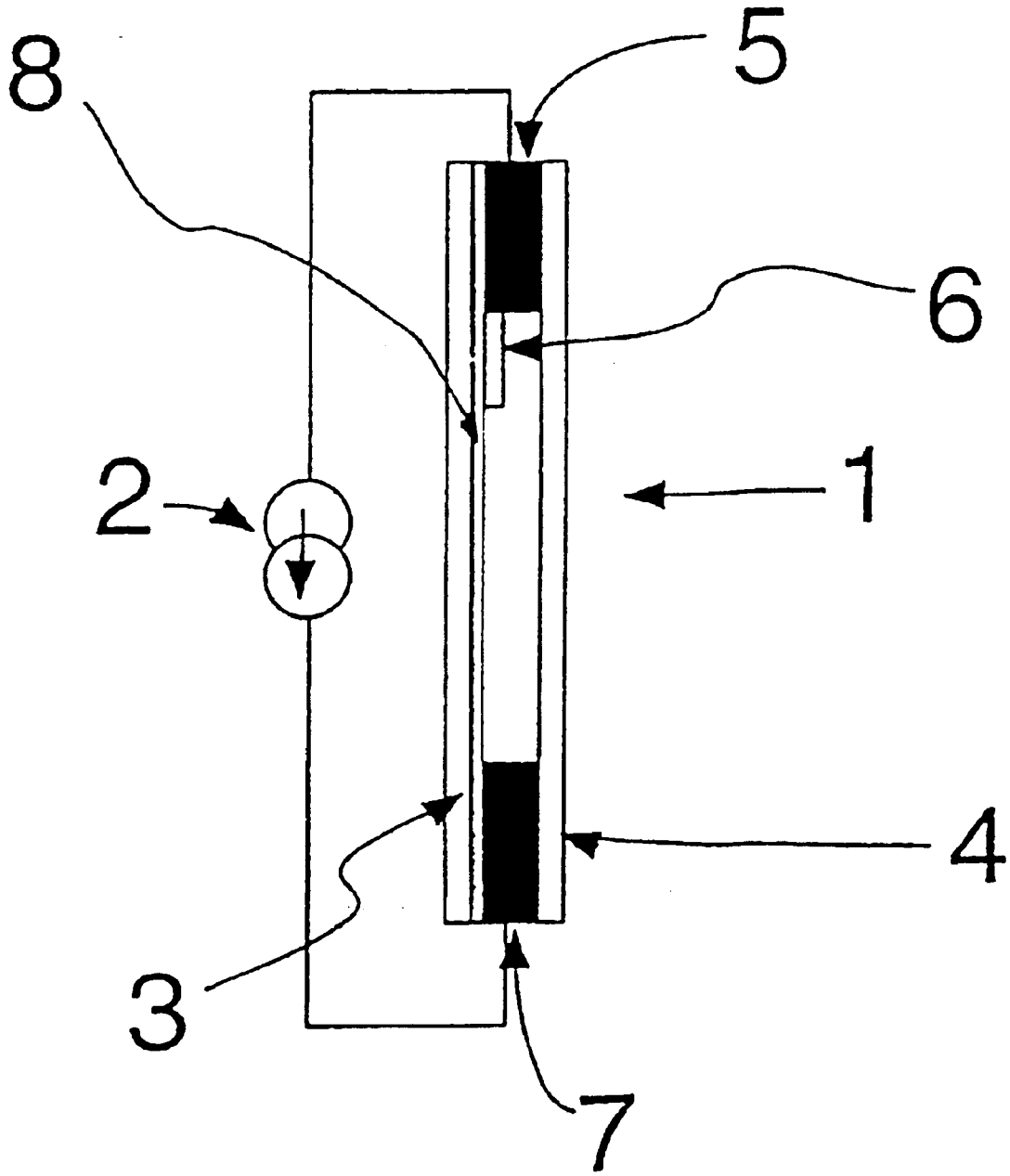
FIG. 1 of the drawing illustrates a device for depositing a continuous layer of metal M on a substrate.

During the operation of the process, the current may vary within the aforementioned range. However, it is preferable to operate in galvanostatic mode by imposing a constant current in order to improve the homogeneity of the film deposited.

The growth rate V of the film which is deposited on the substrate is proportional to the intensity of the electric field. In a parallelepipedal cell, the electric field, and consequently the deposition rate, are directly proportional to the applied current I according to the equation $V=\mu_a I/\sigma S$, in which $\mu_a$ is the mobility of the anion of the salt in the electrolyte, $\sigma$ is the conductivity of the electrolyte and S is the cross section of the cell.

To deposit a given metal M in the form of a homogeneous covering film on a substrate in a given electrochemical cell, for which S, $\sigma$ and $\mu_a$ are consequently known, all that is required is to carry out a trial, within the competence of a person skilled in the art, by changing the intensity of the applied current in order to determine the minimum current intensity which creates the current density sufficient to form a continuous film and no longer dendrites. During electrochemical deposition, as mentioned above, if the intensity of the current is continuously varied from a low value to higher values, it may be seen with the naked eye that the nature of the coating changes. At low intensities, the coating has a coarse arborescent form, with particle sizes markedly less than 1 $\mu$m. When the intensity, i.e. the current density, and therefore the deposition rate, is increased, finer and finer arborescent growths are observed before finally resulting in powders. Surprisingly, and contrary to what is observed in the prior art, the powders formed are deposited on the surface of the substrate, forming a continuous film. The coating starts to form at the top of the substrate in contact with the thin conducting film deposited as cathode and then the deposition front progresses uniformly and regularly downwards along the surface of the substrate to be metallized, towards the anode.

The process of the invention may be used to metallize very varied insulating substrates such as, for example, glass plates or fibres, TEFLON® sheets or yarns, filter paper or ceramic plates.

Various metals M may be used for the metallization. Mention may be made in particular of copper, silver, cobalt, iron and tin. The metal M is introduced into the solvent in the form of a cation associated with an anion in a simple salt, which must have a solubility of greater than $10^{-3}$ mol/l in the solvent. As examples, mention may be made of copper sulphate, copper chloride, silver nitrate, tin chloride and iron chloride.

The solvent for the electrolyte may be aqueous or non-aqueous. Aqueous solutions are particularly preferred for the simplicity of their use. For metallization using a copper sulphate or silver nitrate solution, the salt concentration of the electrolyte is preferably between 0.02 and 0.05 mol/l.

In most cases, it is preferable to pretreat the surface of the substrate to be metallized by depositing a thin non-percolating, and therefore non-conducting, film of a metal M' stable in air in metallic form. Such a pretreatment may consist of depositing islands of gold forming a non-continuous film having a thickness of around 10 to 30 Å. It is also possible to pretreat the surface of the substrate to be metallized with what is called an activating solution, containing palladium chloride which produces palladium islands.

The anode consists of a sheet or a wire of the metal M and serves as a source of metal M. The cathode may be a thin film of the metal M or of another metal, for example M'. For example, if the metal forming the cathode is gold, an approximately 1000 Å film is appropriate.

FIG. 1 shows a device for depositing a continuous layer of metal M on a substrate.

The device comprises an electrochemical cell 1 connected to a generator 2. The cell 1 consists of two rectangular glass plates 3 and 4 placed vertically and parallel to each other, one of the sides (of length L) of the plates being placed horizontally. The substrate to be metallized is that face of the plate 3 facing the inside of the cell. The plates 3 and 4 are kept spaced apart by a distance h by a separator 5. The separator 5 may be a plate or a wire of the metal M or of another metal stable with respect to the electrolyte, that is to say a metal which has a standard oxidation potential greater than that of the metal M, so as to prevent deposition of the electroless type. The distance h is preferably between about 50 $\mu$m and a few mm. A cathode 6, located in the upper part of the plate 3, may consist of a simple metal paint (of the "silver lacquer" type) deposited on the upper edge of the plate 3. An anode 7, located in the lower part of the plate 3, may consist of a wire or a sheet of metal M. The separator 5 also serves as contact between the generator 2 and the electrode 6. The anode 7 also serves as separator. In this embodiment, the anode is connected directly to the substrate. Islands of metal M', as a layer 8 thin enough to be non-percolating, are deposited on that face of the plate 3 which is to be metallized.

In such a cell configuration, for a length L of 1.6 cm and a distance h of 100 $\mu$m, the intensity of the current applied to the cell, which allows a uniform and covering film of metal M to be obtained, is between 100 and 2000 $\mu$A when the concentration C of the salt of the metal M in the electrolyte is around 0.05 mol/litre. This current intensity applied to the electrochemical cell causes a current density of between 2.5 and 50 mA per $cm^2$ of surface in the horizontal section of the cell level with the growth front of the coating.

In the case of a "flat cell" as defined above, the thickness e of the metal film obtained is simply determined by the formula:

$$e=P\times h\times C/C_M$$

in which h represents the distance between the plates 3 and 4, that is to say the width of the electrolyte, C is the cation concentration of the electrolyte and $C_M$ is the molar concentration of the metal M, that is to say the number of mols per litre of M in the solid state. P is a parameter which is a function of the mobility of the cation and of the anion of the salt: $P=1+(\mu_c/\mu_a)$, where $\mu_c$ and $\mu_a$ are the cation mobility and the anion mobility, respectively. As a general rule, the cations and the anions of a salt have very similar mobilities and P is close to 2. The simplified formula for determining e may therefore be written as: $e=2h\times C/C_M$. For example, if the metallization is carried out using a cell in which h=250 $\mu$m, with as electrolyte a solution of a copper salt having a concentration of 0.05 mol/l, the molar density $C_M$ of copper being 293 mol/l, the predicted thickness of the copper film deposited is around $2\times250\times0.05/293=0.085$ $\mu$m. If the electrolyte is a 0.05M silver salt solution, then the thickness of the silver film deposited is $2\times250\times0.05/223=0.11$ $\mu$m.

Figure 2:
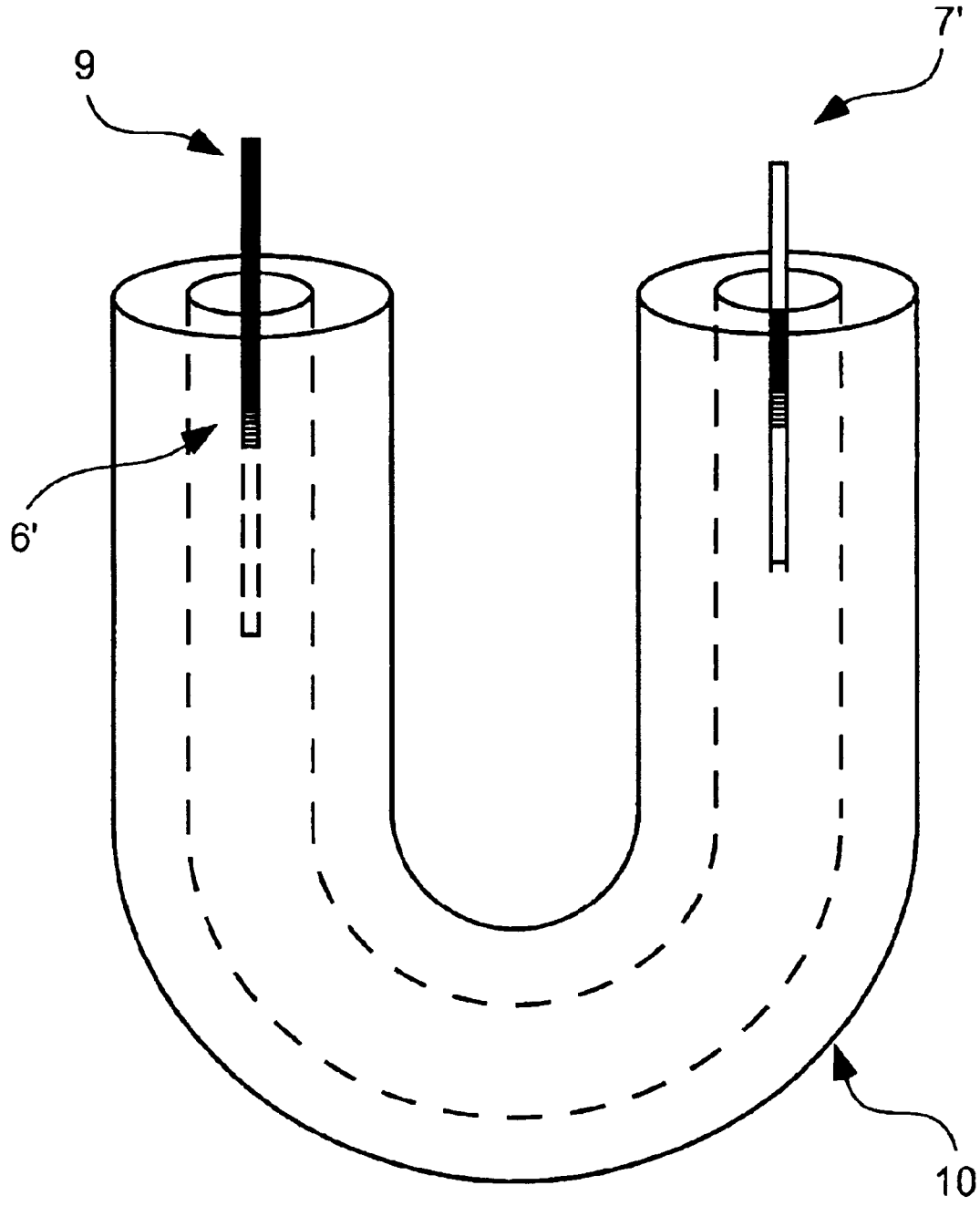
FIG. 2 of the drawing illustrates a device in which the cell consists of a U-shaped cylindrical tube.

FIG. 2 shows another embodiment in which the cell 1' (not shown) consists of a cylindrical tube 10 of radius $R_2$ curved in the form of a U and placed vertically. The substrate to be metallized is a yarn 9 of radius $R_j$, such as a glass fiber for example. The yarn 9 is very carefully cleaned and possibly covered with a film of the metal M', for example a non-percolating film of gold. For yarns of smaller diameter (of the order of 100 $\mu$m), the treatment with a metal M' is unnecessary. The yarn 9 is covered at one of its ends with a metal coating forming the cathode 6', which is connected to a generator (not shown). The other end of the yarn 9 is introduced into one of the openings of the U-tube which contains the electrolyte. A wire of metal M is introduced into the U-tube via the other opening and forms a consumable anode 7'. In the embodiment shown, the yarn 9 is not connected directly to the anode. Its length could, however, be such that it does join the end of the yarn serving as anode. The thickness e of the metal coating obtained may be determined from the formula $e=[(R_2^{2-R_1^2})/R_1]\times C/C_M$, in which C and $C_M$ have the meanings given above.

It is thus apparent that, in a given electrochemical cell containing a substrate of given shape, and for a given metal M, the thickness e of the film may be varied by modifying the concentration of salt of metal M in the electrolyte.

Whatever the shape of the electrochemical cell used, when a voltage is applied to it, the coating of metal M starts to grow along the cathode, on that surface of the substrate to be metallized. The thin film which forms progressively invades the surface to be metallized, as the growth front of the coating moves away from the cathode. If the substrate is a glass plate, a mirror is obtained.

The electrochemical cell may be adapted in such a way that the metal M is deposited continuously. The substrate is then pulled vertically upwards through the cell, provided that the part immersed in the electrolyte is covered with metal.

EXAMPLE 1

One face of a small glass plate was metallized using a device as shown in FIG. 1.

The length L was 1.6 cm and the distance h between the small plates 3 and 4 was 250 $\mu$m. The intensity of the current applied to the cell was 600 $\mu$A. The electrolyte was a 0.05 mol/litre aqueous silver nitrate solution. A uniform covering film having a thickness of around 0.1 $\mu$m was thus obtained.

EXAMPLE 2

A glass fibre was metallized in a device as shown in FIG. 2.

The cell consisted of a segment of a glass capillary tube, having an inside diameter of 1 mm and a length of 3 cm, bent into a U, so that the two openings were located at the top, in order to prevent the electrolyte from dispersing by gravity. The tube was filled with a silver nitrate solution. The glass fibre, which had a diameter of 200 $\mu$m, was coated with a silver lacquer initiator and introduced vertically into one of the openings, until the cathode part serving as initiator was immersed into the electrolyte to a depth of about 2 mm. A silver wire serving as counterelectrode (the anode) was introduced into the other opening. The current was made to flow through the tube, imposing a constant current of 100 $\mu$A between the initiator on the fibre and the anode. A uniform coating of a metal film on the fibre was thus obtained. The fibre was then removed by pulling it upwards, taking care to ensure that the metallized fibre did not scrape the edges of the lass tube.

What is claimed is:

1. Process for metallizing an insulating substrate by depositing a uniform thin film of a metal M on the insulating substrate, comprising:

placing the insulating substrate in an electrochemical cell which contains as electrolyte a solution of a salt of the metal M in a solvent and which includes an anode of the metal M and a cathode in direct contact with the insulating substrate, and carrying out an electrolysis at constant current, wherein:

a conducting film, which will constitute the cathode, is initially applied to one end of the substrate;

the substrate is placed in a vertical position in the electrochemical cell such that the surface to be metallized is vertical and the cathode is adhered to an upper part of the substrate; and the current is imposed on the electrochemical cell with an intensity such that it creates a current density of between 1 and 50 mA/cm$^2$ in a horizontal section of the electrochemical cell level with the growth front of the film which is deposited.

2. Process according to claim 1, wherein the insulating substrate is a glass plate or yarn, or a TEFLON® sheet or yarn, or filter paper or a ceramic plate.

3. Process according to claim 1, wherein the metal M is copper, silver, cobalt, iron or tin.

4. Process according to claim 1, wherein the electrolyte is an aqueous copper sulphate, copper chloride, silver nitrate, tin chloride or iron chloride solution having a salt concentration of greater than $10^{-3}$ mol/l.

5. Process according to claim 4, wherein the salt concentration is between 0.02 and 0.05 mol/l.

6. Process according to claim 1, wherein the surface of the substrate to be metallized is pretreated by coating it with a thin non-continuous, non-conducting metal film of a metal stable in air in metallic form.

7. Process according to claim 6, wherein the thin non-continuous, non-conducting metal film is gold or palladium.

8. Process according to claim 1, wherein the intensity of the current applied to the electrochemical cell is between 2.5 and 50 mA for a cell cross section of 1 cm$^2$.

9. Process according to claim 1, wherein the substrate is a rectangular plate placed vertically in the electrochemical cell, an upper part of the carrying the conducting film serving as cathode and a lower part of the plate connected to the node of metal M.

10. Process according to claim 1, wherein the substrate is yarn, one end of which is covered with a conducting film and constitutes the cathode, the other end being either free or connected directly to an anode of metal M.

* * * * *